US009347229B2

(12) United States Patent
Ken-Dror et al.

(10) Patent No.: US 9,347,229 B2
(45) Date of Patent: May 24, 2016

(54) ADJUSTABLE SAWHORSE

(71) Applicant: THE STANLEY WORKS ISRAEL LTD., Rosh Ha'Ayin (IL)

(72) Inventors: Boaz Ken-Dror, Tel-Aviv (IL); Sharon Fella Bar-Erez, Emek Hefer (IL); Yosi Sabbag, Holon (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 13/685,062

(22) Filed: Nov. 26, 2012

(65) Prior Publication Data

US 2013/0140110 A1 Jun. 6, 2013

(30) Foreign Application Priority Data

Dec. 1, 2011 (EP) ..... 11191567

(51) Int. Cl.
*E04G 1/32* (2006.01)
*B25H 1/06* (2006.01)
*B25H 1/16* (2006.01)

(52) U.S. Cl.
CPC .. *E04G 1/32* (2013.01); *B25H 1/06* (2013.01); *B25H 1/16* (2013.01)

(58) Field of Classification Search
CPC ..... E04G 1/32; B25H 1/16
USPC ..... 182/181.1, 182.1
See application file for complete search history.

(56) References Cited

U.S. PATENT DOCUMENTS 376,876 A 1/1888 Goodrich
881,556 A * 3/1908 Dehler ..... 182/153
2,573,740 A * 11/1951 Spikings, Jr. ..... 182/155
3,276,545 A * 10/1966 Angelo ..... 182/153
3,480,110 A * 11/1969 Coleman ..... 182/182.4
3,599,751 A * 8/1971 Mueller ..... 182/129
4,031,981 A * 6/1977 Spencer ..... 182/153

(Continued)

FOREIGN PATENT DOCUMENTS

DE 100 52 647 A1 5/2002
DE 202011105979 U1 * 4/2012
GB 2 340 787 A 3/2000

OTHER PUBLICATIONS

Ronald Popma, European Search Report, May 3, 2012, The Hague.

(Continued)

*Primary Examiner* — Alvin Chin-Shue
(74) *Attorney, Agent, or Firm* — Gabriel A. Haboubi

(57) ABSTRACT

The invention provides a sawhorse comprising a base assembly movable between a folded position for storage and an open position for use and a workpiece support assembly having a workpiece supporting surface which faces upwardly when the base assembly is in the open position for use thereof, said workpiece support assembly being mounted on the base assembly for vertical movement in opposite directions with respect to the base assembly through a range of vertical positions. The base assembly and the workpiece support assembly has a cooperating structure operable to enable the workpiece support assembly to be manually moved in said opposite directions into a selected vertical position with respect to the base assembly, which adjustably engages the workpiece support assembly in the selected vertical position and which is operable to move the workpiece support assembly when the base assembly is in the folded position or in the open position.

7 Claims, 5 Drawing Sheets

(56) References Cited

U.S. PATENT DOCUMENTS

| | | | | |
|---|---|---|---|---|
| 5,709,373 | A * | 1/1998 | Wasylynko | 269/16 |
| 5,865,269 | A | 2/1999 | Eskesen | |
| 6,298,946 | B1 * | 10/2001 | Yemini et al. | 182/153 |
| 6,419,048 | B1 * | 7/2002 | Robinson et al. | 182/182.1 |
| 6,871,920 | B2 * | 3/2005 | Greenwald et al. | 312/334.4 |
| 7,428,668 | B2 * | 9/2008 | Kikuchi et al. | 714/701 |
| 2005/0230188 | A1 | 10/2005 | Berg | |

OTHER PUBLICATIONS

Annex to the European Search Report on European Patent Application No. EP 11 19 1567.

* cited by examiner

ADJUSTABLE SAWHORSE

CROSS-REFERENCE TO RELATED APPLICATIONS

This application claims priority, under 35 U.S.C. §119, to European Patent Application No. 11191567.4, filed Dec. 1, 2011, titled "ADJUSTABLE SAWHORSE".

FIELD OF THE INVENTION

The present invention relates to a sawhorse and, more particularly, to a height adjustable sawhorse.

BACKGROUND OF THE INVENTION

A sawhorse is a movable frame or trestle for supporting wood while it is being sawed or for supporting plates to provide working spaces. Conventional sawhorses commonly are comprised of a body and base members that support the body. The body is used to support workpieces that are to be cut or otherwise worked on. A sawhorse typically includes base members comprising either four legs or two pairs of legs, wherein the base members are hingedly connected at the tops thereof. The sawhorse may further comprise a locking mechanism which defines the working spread of the legs at their bottom.

For whatever purpose it is employed, it is advantageous for a sawhorse to be adjustable both in height and in working width. Height adjustability is advantageous because it enables users of different heights to adjust the height of the sawhorse to be most comfortable for them. Working width adjustability is advantageous as it enables working width versatility. A variety of known means can be used to provide working width adjustability.

Prior art sawhorses are known which are height adjustable. Such devices may have extendible/retractable extensions housed by the lower ends of their base members. Such devices suffer a limitation because the process of height adjustability is highly demanding. It requires a user to independently adjust four individual extensions in each sawhorse. Adjustment of each of the four extensions calls for removing the workpiece, bending over (or turning the sawhorse upside down), pulling out each extension and securing it in its new extended or retracted position. For stability, measures should be taken by the user to ensure that all extensions are extended to a similar extent.

Alternatively, the height may be adjustable by means of a height adjustable body. A vertically extendible top member may be constructed and arranged to be adjustably mounted at varying heights with respect to the base assembly. The extendible top member typically includes an elongated, laterally extending top element constructed and arranged to form the body of the sawhorse and support a workpiece, and a pair of elongated extension elements that are constructed and arranged to be adjustably engaged at varying vertical positions relative to the base assembly so as to adjust the height of the top element. In known height adjustable sawhorses of this type, the vertical position of the extension elements can be adjusted only when the base members are in the folded position, not when the base members are in the open working position. In order to adjust the height, the user must remove the workpiece, close the sawhorse, adjust the height of the body, reopen the sawhorse and reposition it before recommencing work.

There is thus a widely recognised need for, and it would be highly advantageous to have, an improved height adjustable sawhorse. There is also a recognized need to improve the loading capacity of sawhorses in general.

BRIEF SUMMARY OF THE INVENTION

Thus, according to the present invention there is provided a sawhorse comprising a base assembly movable between a folded storage position and an open position for use. A height adjustable workpiece support assembly comprising an elongated, laterally extending top element constructed and arranged to support a workpiece, having a workpiece supporting surface which faces upwardly when the base assembly is in the open position for use thereof, is constructed and arranged to be adjustably mounted at varying heights with respect to the base assembly. The sawhorse comprises a pivoted bar which is constructed and arranged so as to adjustably engage the top member at varying heights relative to the base assembly, and which is operable to allow the workpiece support assembly to be moved when the base assembly is in the folded position or in the open position. The pivoted bar is operable to adjustably engage the workpiece support assembly at the selected height and enables the workpiece support assembly to be moved when the base assembly is in the folded position or in the open position.

The base assembly may include a first base member and a second base member, the first base member having a first top end, and the second base member having a second top end. The second base member is pivotally connected at the second top end to the first top end of the first base member. The first and second base members are pivotally movable to change the sawhorse from the folded position to the open position and vice versa.

At least a part of the at least one pivoted bar may be located inside a channel within the workpiece support assembly or the base assembly. This protects the pivoted bar and associated parts from damage or interference and streamlines the sawhorse. The sawhorse may include two similar pivoted bars, which are spaced apart from each other along the lateral length of the workpiece support assembly. This arrangement stabilises the sawhorse support along its length and spreads the load of the workpiece across more than one main load point.

In one embodiment, the at least one pivoted bars comprise a height adjusting knob spaced apart from the pivot and an engaging protrusion spaced apart from the pivot; wherein the height adjusting knob and the engaging protrusion may be spaced apart from each other in different directions along the pivoted bar from the pivot. In one particular embodiment, the height adjusting knob is at the end of the pivoted bar closest to the workpiece support assembly, and the engaging protrusion is at the other end of the pivoted bar. This arrangement can allow the height adjusting knob to be activated by the user while they also pull or push the workpiece support assembly away from or towards the base assembly in order to adjust the height. The height adjusting knob can be positioned such that it can be activated with the same hand as that used to pull or push the workpiece support assembly, which results in improved ease of adjustment.

When present, the engaging protrusion should be able to engage with a selected one of one or more engaging points in the base assembly in order to adjustably engage the workpiece support assembly at the selected height. The engaging protrusion may comprise an undercut groove which lockingly engages with a portion of the selected engaging point while the workpiece support assembly is loaded, in order to prevent accidental changes of the height. Such an arrangement means that the workpiece support assembly must be substantially unloaded before it is possible to adjust the height.

The one or more engaging points may be in the form of holes, notches or ledges, for example holes cut through, notches cut into or ledges protruding from the base assembly or the workpiece support assembly. The engaging points must be of a shape and nature which permits the engaging protrusion of the pivoted bar to engage with a selected one of them in order to position the workpiece support assembly at the selected height.

In one embodiment, the sawhorse may comprise a height measuring assembly constructed and arranged to indicate a height to which the workpiece support assembly has been moved. This may take the form of a height measuring indicia on the base assembly, and an indicator on part of the pivoting bar for indicating a height of the workpiece support assembly utilizing the indicia.

Sawhorses according to the invention may further comprise a spread limiting mechanism operatively connected to the base assembly for limiting an unfolding movement of the base assembly when the base assembly is moved into its open position for use, the spread limiting mechanism optionally providing a support surface that functions as a shelf when the base assembly is in its open position for use.

The sawhorse may incorporate other features such as width adjustment of the workpiece support assembly.

The present invention successfully addresses the shortcomings of the presently known configurations by providing an improved height adjustable sawhorse.

BRIEF DESCRIPTION OF THE DRAWINGS

The invention is herein described, by way of example only, with reference to the accompanying drawings, wherein.

DETAILED DESCRIPTION OF THE INVENTION

Figure 2:
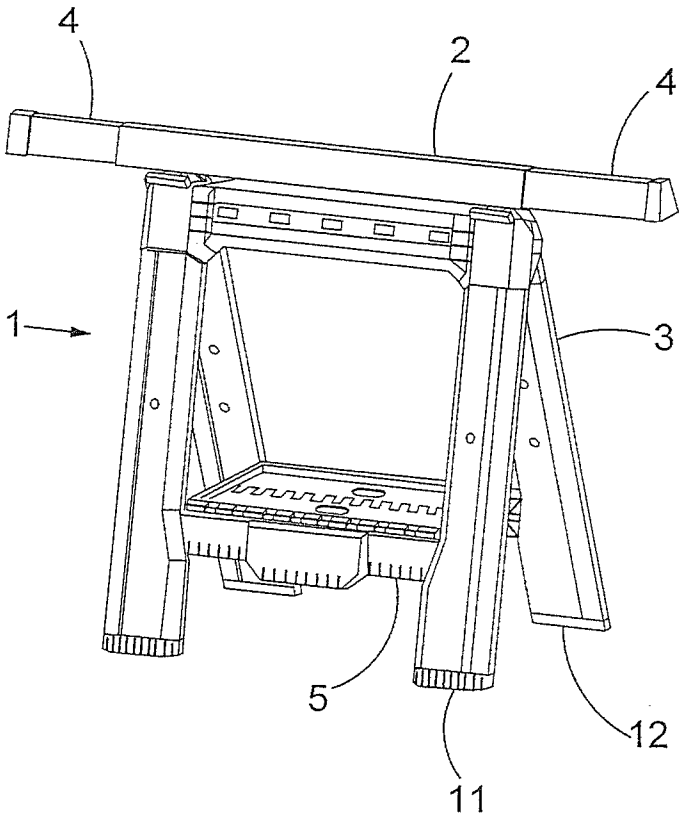
FIG. 2 is a perspective view of a sawhorse according to the invention, in which the workpiece support assembly is shown in a width extended state.
Figure 1:
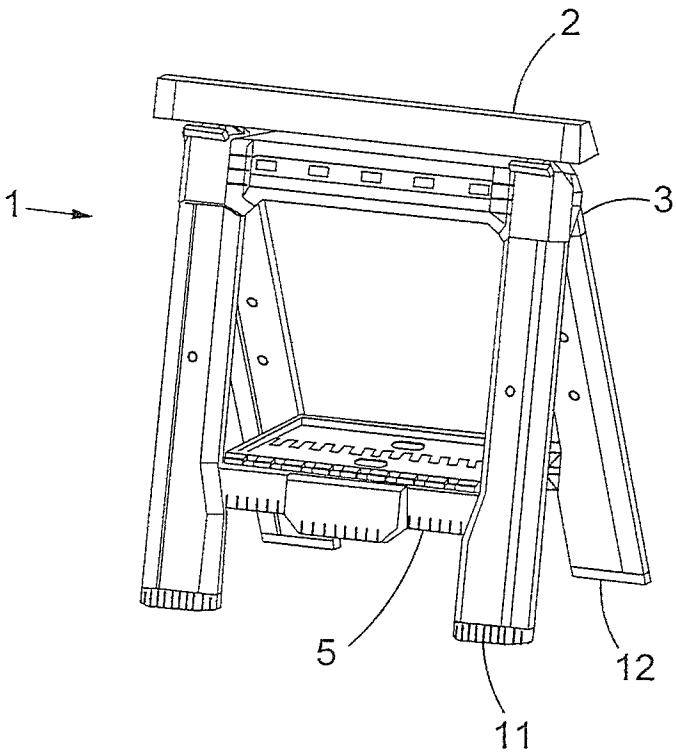
FIG. 1 is a perspective view of a sawhorse according to the invention.

FIG. 1 shows a sawhorse 1 according to the invention, in the open position. Sawhorse 1 comprises workpiece support assembly 2 and base assembly 3. FIG. 2 shows the same sawhorse with width adjustment assembly 4 in an extended position. Width adjustment assembly 4 may comprise two rods slidably engaged in a channel of the workpiece support assembly, which are connected via a rack and spur gear, such that when one rod end is pushed or pulled in order to slide it into or out of the workpiece support assembly, the other rod automatically slides a similar distance in the opposite direction. In this embodiment, a spread limiting mechanism 5 is included, which is in the form of a shelf, and base member 3 comprises a first base member 11 comprising a first pair of legs and a second base member 12 comprising a second pair of legs, the two base members being hingedly connected.

Figure 4:
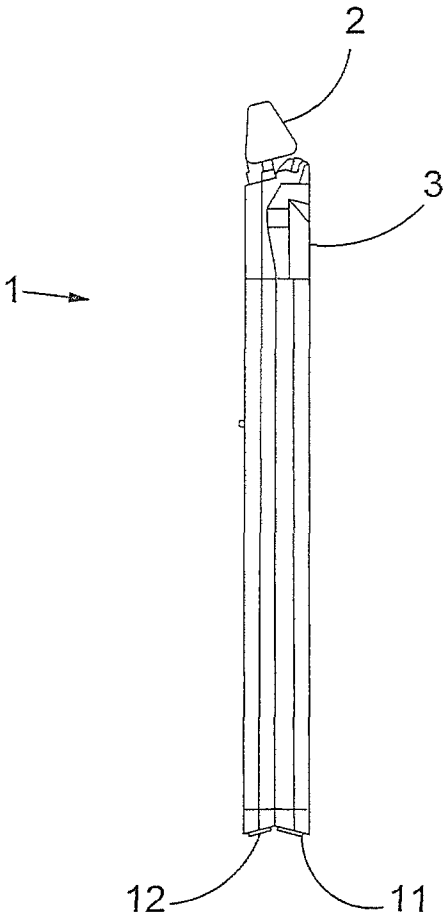
FIG. 4 is a side view of a sawhorse according to the invention, in a closed position.
Figure 3:
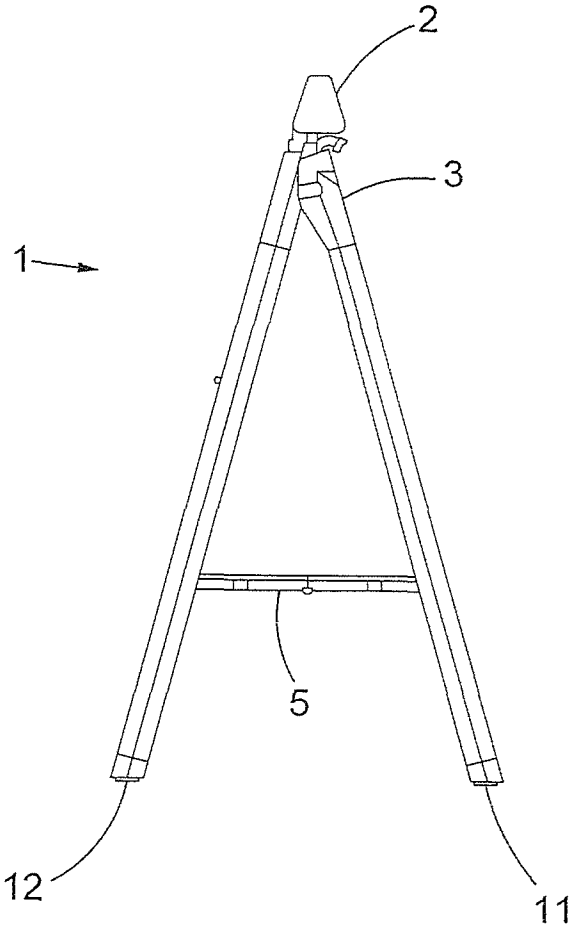
FIG. 3 is a side view of a sawhorse according to the invention, in an open position.
Figure 6:
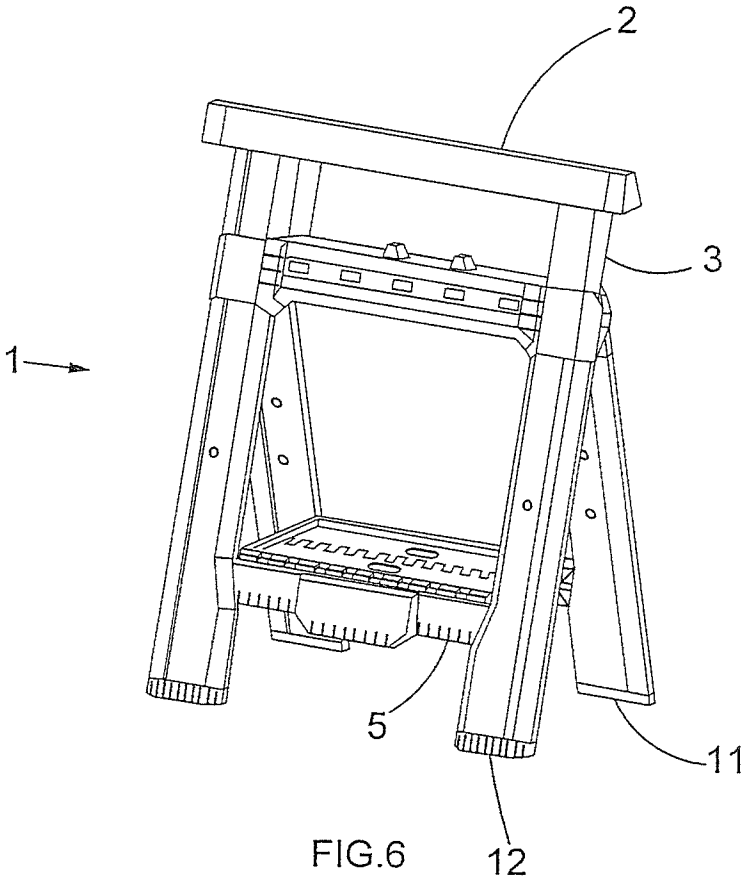
FIG. 6 is a perspective view of a sawhorse according to the invention, in an open position, with the workpiece support assembly positioned at a high height.
Figure 5:
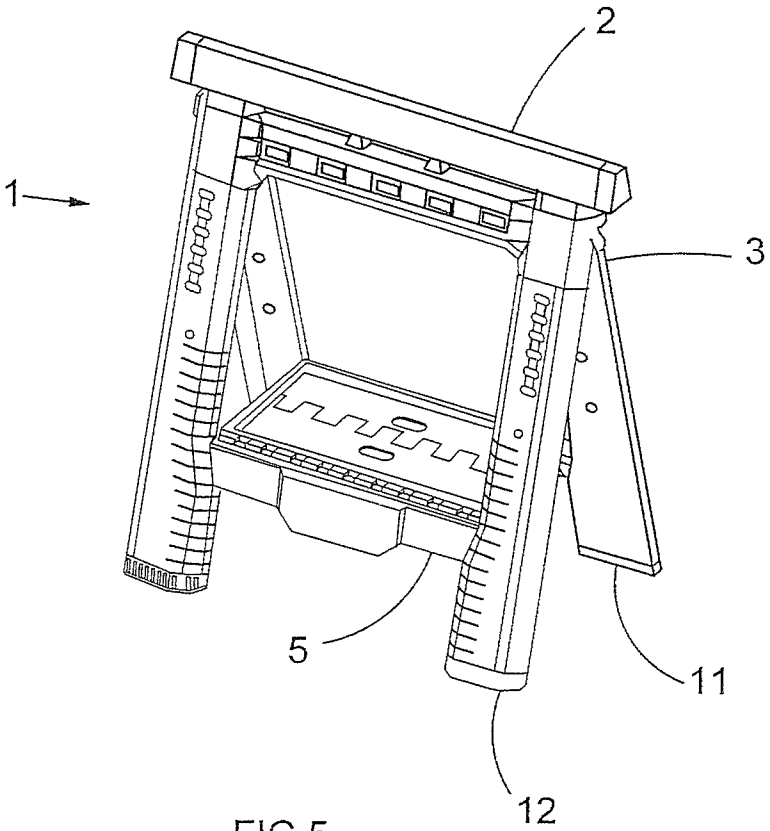
FIG. 5 is a perspective view of a sawhorse according to the invention, in an open position with the workpiece support assembly positioned at a low height.

FIG. 3 shows a sawhorse 1 according to the invention, in the open position, and FIG. 4 shows the sawhorse 1 in the closed position. FIG. 5 shows a sawhorse according to the invention, in an open position with the workpiece support assembly positioned at a low height, while FIG. 6 shows the workpiece support assembly raised to a higher height.

Figure 8:
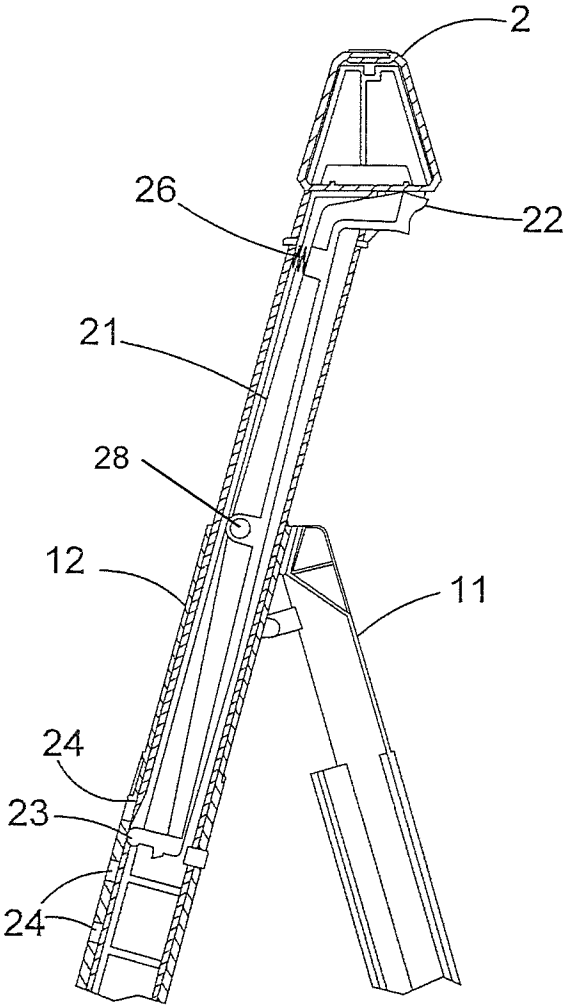
FIG. 8 is a view similar to FIG. 7, with the workpiece support assembly positioned at a high height.
Figure 7:
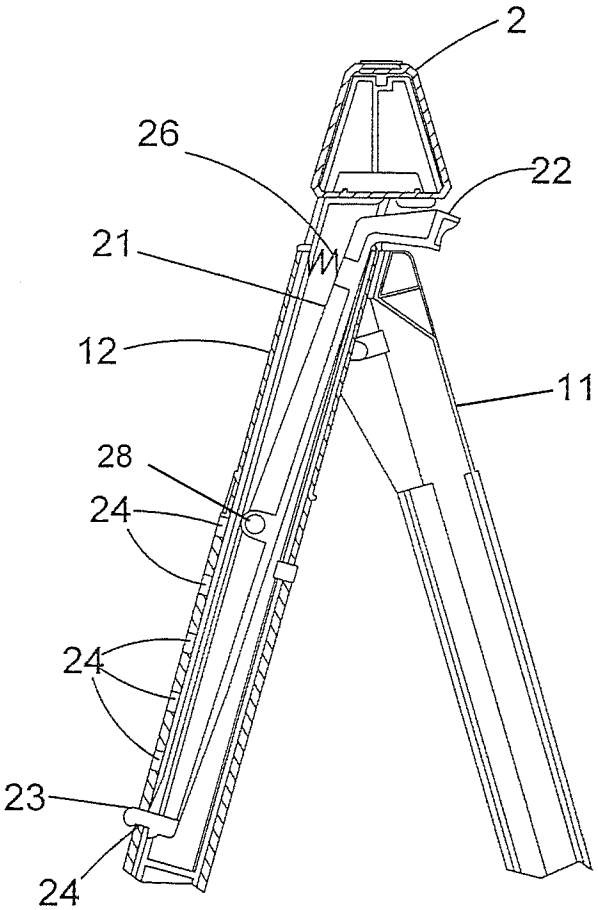
FIG. 7 is a cutaway side view of part of a sawhorse according to the invention, in an open position, showing a height adjustment mechanism, with the workpiece support assembly positioned at a low height.

FIGS. 7 and 8 show a portion of the sawhorse of FIG. 1, with the workpiece support assembly in a low height position and high height position respectively. Pivoted bar 21 turns about pivot point 28. In the embodiment shown, pivoted bar 21 is located within a channel of a lower part of the workpiece support assembly 2. This lower part of the workpiece support assembly slides within a channel of the base assembly. There may be one or two or more separate pivoted bars. Preferably there are two identical pivoted bars, spaced apart from each other along the lateral length of the workpiece support assembly, one associated with each of the two legs of second base part 12. Such an arrangement results in a sawhorse which can support high loads reliably, without failure at either end of the workpiece support assembly.

A plurality of engaging points 24 of the base assembly 3 are shown, which in this embodiment are in the form of holes. However, it will be evident that the engaging points could take alternative forms, for example notches cut into or ledges protruding from the interior surface of the base assembly 3, as long as they are of a shape and nature which permits the engaging protrusion of the pivoted bar to engage with a selected one of them in order to position the workpiece support assembly at the selected height. If, as here, the engaging points are in the form of holes, then it can be seen which hole engaging point 24 an engaging protrusion 23 is engaged with, which can provide the user with a useful indication of the current height of the sawhorse.

Figure 9:
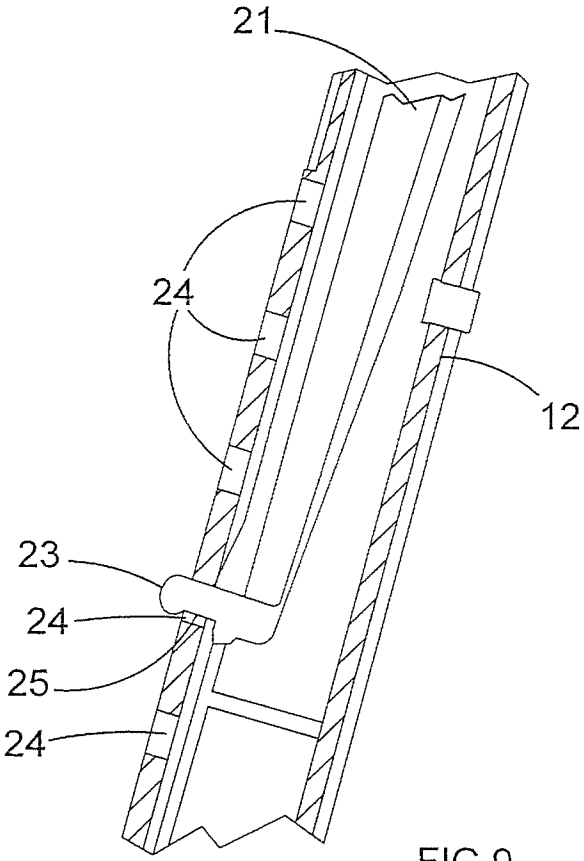
FIG. 9 is a close-up cutaway view of part of a sawhorse according to the invention.

Pivoted bar 21 comprises a height adjusting knob 22 and the engaging protrusion 23. In this embodiment, as shown in FIG. 9, the engaging protrusion 23 has an undercut groove 25 which can lockingly engage with a portion of the engaging points 24, so that when the sawhorse is loaded, the height of the workpiece support assembly is held at a fixed position because the engaging protrusion 23 cannot easily or accidentally be disengaged allowing the workpiece support assembly position to fall.

If it is necessary to change the height of the workpiece support assembly, height adjusting knob 22 must be pushed to turn pivoted bar 21 about the pivot point 28, against the action of spring 26. This disengages engaging protrusion 23 from its current engagement point 24, and the workpiece support assembly can slide to a different height relative to the base assembly. When the desired height is reached, height adjusting knob 22 is released and spring 26 acts to turn pivoted bar 21 in the opposite direction about the pivot point, in order to reengage engaging protrusion 23 with a new engagement point 24.

Figure 10:
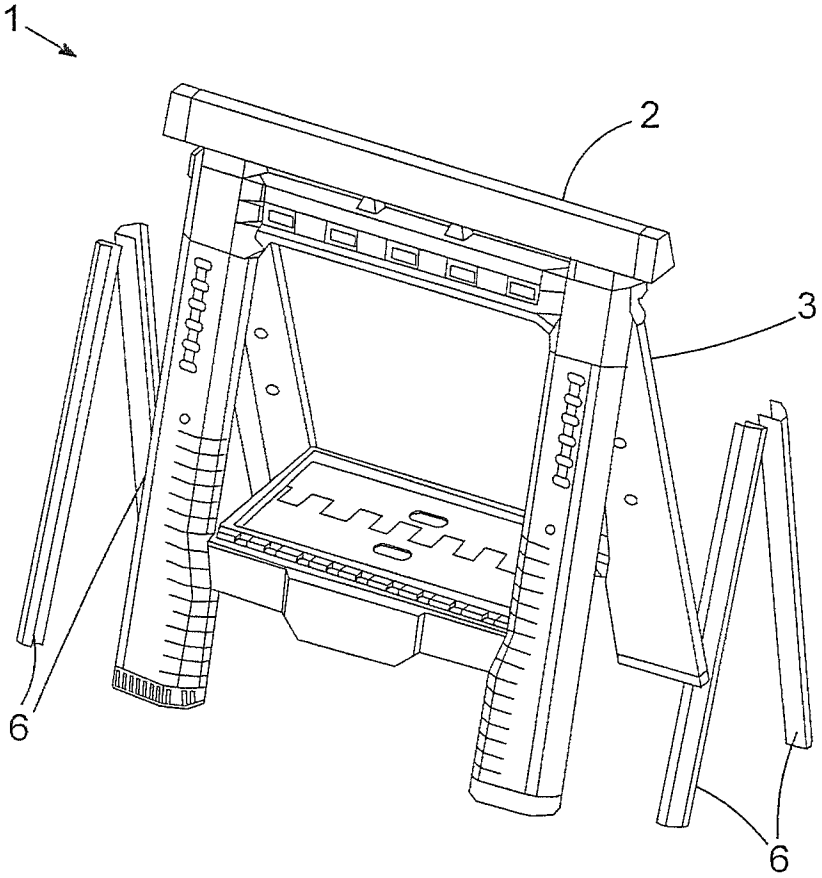
FIG. 10 is an exploded perspective view of another sawhorse according to the invention.

FIG. 10 shows a partially exploded perspective view of a sawhorse according to the invention. In this embodiment base assembly 3 is manufactured from a plastics material, and reinforcing struts 6 are manufactured from a metal. Fixation of struts 6 onto the legs of base assembly 3 can significantly improve the load carrying capacity of the sawhorse.

It should be understood that although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the claims.

The invention claimed is:

1. A sawhorse configured to support a workpiece, the sawhorse comprising:

a base assembly movable in a movable direction between a folded position for storage and an open position for use;

a workpiece support assembly extending transversely to the movable direction of the base assembly, the workpiece support assembly having a workpiece supporting surface being an uppermost surface of the sawhorse which faces upwardly when the base assembly is in the open position for use thereof, said workpiece support assembly being mounted on the base assembly for movement with respect to the base assembly through a range of heights;

at least one pivoted bar operable to enable the workpiece support assembly to be moved to a selected height with respect to the base assembly;

said pivoted bar being operable to adjustably engage the workpiece support assembly at the selected height, said pivoted bar being operable to move the workpiece support assembly when the base assembly is in the folded position or in the open position, wherein the at least one pivoted bar comprises a height adjusting protrusion adjacent to the workpiece support assembly and spaced apart from a pivot, and an engaging protrusion spaced apart from the pivot, wherein the height adjusting protrusion and the engaging protrusion are spaced apart from each other in different directions along the pivoted bar from the pivot, wherein the engaging protrusion is operable to engage with a selected one of one or more engaging points in the base assembly in order to adjustably engage the workpiece support assembly at the selected height, and user activation of the height adjusting protrusion disengages the engaging protrusion from the one or more engaging points;

wherein the at least one pivoted bar is disposed within a base assembly channel, and wherein the height adjusting protrusion and the at least one pivoted bar are configured to be raised or lowered with the workpiece support assembly, and the height adjusting protrusion is configured to remain adjacent to the workpiece supporting surface as the workpiece support assembly moves with respect to the base assembly through the range of heights, such that a user may actuate disengaging the workpiece support assembly from the base assembly and raising the workpiece support assembly relative to the base assembly through same hand simultaneous engagement of the height adjusting protrusion and the workpiece supporting surface.

2. A sawhorse in accordance with claim 1, wherein at least a part of the at least one pivoted bar is located inside a workpiece support assembly channel.

3. A sawhorse in accordance with claim 1, comprising two pivoted bars which are spaced apart from each other along a lateral length of the workpiece support assembly.

4. A sawhorse in accordance with claim 1, wherein the engaging protrusion comprises an undercut groove which lockingly engages with a portion of the selected engaging point while the workpiece support assembly is loaded.

5. A sawhorse in accordance with claim 4, wherein the one or more engaging points are in the form of holes, notches or ledges.

6. A sawhorse in accordance with claim 1, further comprising a spread limiting mechanism operatively connected to the base assembly for limiting an unfolding movement of the base assembly when the base assembly is moved into its open position for use, the spread limiting mechanism optionally providing a support surface that functions as a shelf when the base assembly is in its open position for use.

7. A sawhorse in accordance with claim 1, wherein the height adjusting protrusion comprises a height adjusting knob.

* * * * *